US009765610B2

(12) United States Patent
Turner et al.

(10) Patent No.: US 9,765,610 B2
(45) Date of Patent: Sep. 19, 2017

(54) REAL-TIME TRACKING AND MITIGATING OF BENDING FATIGUE IN COILED TUBING

(71) Applicant: Halliburton Energy Services, Inc., Houston, TX (US)

(72) Inventors: Alan Charles John Turner, Aberdeenshire (GB); Richard Ian Gillings, Aberdeenshire (GB); George Stewart Cooper, Aberdeenshire (GB); Iain James Shepherd, Aberdeenshire (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/896,709

(22) PCT Filed: Feb. 13, 2015

(86) PCT No.: PCT/US2015/015906

§ 371 (c)(1),
(2) Date: Dec. 8, 2015

(87) PCT Pub. No.: WO2016/130155

PCT Pub. Date: Aug. 18, 2016

(65) Prior Publication Data

US 2016/0369614 A1 Dec. 22, 2016

(51) Int. Cl.
*E21B 17/20* (2006.01)
*E21B 19/22* (2006.01)
(Continued)

(52) U.S. Cl.
CPC ..... *E21B 47/0006* (2013.01); *E21B 17/20* (2013.01); *E21B 19/002* (2013.01);
(Continued)

(58) Field of Classification Search
CPC ..... E21B 17/20; E21B 19/002; E21B 19/08; E21B 19/22; E21B 19/24; E21B 47/0006; B63B 35/03
See application file for complete search history.

(56) References Cited

U.S. PATENT DOCUMENTS 3,685,306 A * 8/1972 Mott ..... F16L 1/203 226/24
5,188,174 A 2/1993 Anderson, Jr.
(Continued)

OTHER PUBLICATIONS

Search Report received in corresponding Application NL1041668, dated Sep. 27, 2016.
(Continued)

*Primary Examiner* — Matthew R Buck
(74) *Attorney, Agent, or Firm* — McDermott Will & Emery LLP

(57) ABSTRACT

A coiled tubing deployment system includes an offshore rig having a reel positioned thereon and coiled tubing wound on the reel. A guide arch receives the coiled tubing from the reel and a monitoring support guide fixed to the offshore rig receives and directs the coiled tubing into water. The monitoring support guide has a frame and at least two hydraulic rams. A depth counter measures the coiled tubing deployed from the reel and generates length measurement signals, and sensors coupled to the at least two hydraulic rams measure real-time lateral movement of the coiled tubing with respect to the monitoring support guide as the coiled tubing is deployed into the water and thereby generate sensor signals. A data acquisition system receives and processes the length measurement and sensor signals to provide an output signal indicative of real-time bending fatigue of the coiled tubing at select locations along the coiled tubing.

26 Claims, 3 Drawing Sheets

(51) Int. Cl.

| | |
|---|---|
| ***E21B 19/24*** | (2006.01) |
| ***E21B 47/00*** | (2012.01) |
| ***E21B 19/00*** | (2006.01) |
| ***E21B 19/08*** | (2006.01) |
| *B63B 35/03* | (2006.01) |

(52) U.S. Cl.
CPC ..... *E21B 19/08* (2013.01); *E21B 19/22* (2013.01); *E21B 19/24* (2013.01); *B63B 35/03* (2013.01)

(56) References Cited

U.S. PATENT DOCUMENTS

| | | | | |
|---|---|---|---|---|
| 6,321,596 | B1 * | 11/2001 | Newman | E21B 19/22 73/152.45 |
| 6,408,948 | B1 * | 6/2002 | Fontana | B63B 21/502 166/341 |
| 7,080,557 | B2 * | 7/2006 | Adnan | G01N 29/225 73/622 |
| 8,439,109 | B2 * | 5/2013 | Sbordone | E21B 47/0001 166/250.01 |
| 8,451,441 | B2 * | 5/2013 | Nicolas | E21B 17/017 356/241.4 |
| 8,548,742 | B2 | 10/2013 | Pugh et al. | |
| 9,022,124 | B2 * | 5/2015 | Sorensen | E21B 19/22 166/351 |
| 2004/0065475 | A1 * | 4/2004 | Laursen | E21B 19/24 175/7 |
| 2004/0200282 | A1 | 10/2004 | Adnan | |
| 2006/0101914 | A1 | 5/2006 | McCoy | |
| 2010/0057279 | A1 | 3/2010 | Kyllingstad | |
| 2014/0207390 | A1 | 7/2014 | Zheng et al. | |

OTHER PUBLICATIONS

International Search Report and Written Opinion for PCT/US2015/015906 dated Sep. 25, 2015.

* cited by examiner

REAL-TIME TRACKING AND MITIGATING OF BENDING FATIGUE IN COILED TUBING

BACKGROUND

Exploring, drilling, and completing a hydrocarbon or other type of subterranean well is generally a complicated, time-consuming, and ultimately very expensive endeavor. As such, tremendous emphasis is commonly placed on well access in the hydrocarbon recovery industry. That is, access to a well at an oilfield for monitoring its condition and maintaining its proper health is of great importance. Such access to the well is often provided by way of coiled tubing, which is particularly well suited for being driven downhole to depths of several thousand feet by an injector located at the surface. The coiled tubing is generally of sufficient strength and durability to withstand such applications. For example, the coiled tubing may be made of alloy steel, stainless steel, or other suitable metal-based materials.

Coiled tubing is deployed from a coiled tubing reel that can be manageably delivered to a well site. Despite being constructed of relatively durable materials, the coiled tubing plastically deforms while winding and unwinding from the reel, which affects the low cycle fatigue life of the coiled tubing. Repeated cycling (e.g., winding and unwinding) of the coiled tubing will eventually cause the coiled tubing to lose its structural integrity in terms of force bearing capacity or pressure bearing capacity. In extreme scenarios, the wall of the coiled tubing may fail at an over-fatigued location, thereby rendering the coiled tubing unsafe or wholly unusable. In order to avoid fatigue failure during operations, the coiled tubing is generally 'retired' once a predetermined fatigue life or limit has been reached.

To calculate when the predetermined fatigue life or limit has been reached, the coiled tubing reel may be equipped with a data storage system and processor configured to monitor historical cycling or bending of the coiled tubing during operations and comparing those determinations against a fatigue life model. A degree of accuracy may be provided whereby bending of each segment of the coiled tubing is tracked as it winds and unwinds from the reel and bends in one direction or another through the turns of the injector as it advances into or is retracted from a well. As such, from one operation to the next, the actual degree of cycling for any given segment may be historically tracked. Once segments of the coiled tubing begin to reach the limits established based on the fatigue life model, the process of retiring of the coiled tubing may ensue.

When coiled tubing is used in riser-less subsea operations, however, the coiled tubing is advanced into an oftentimes turbulent ocean environment. As a result, significant bending can be assumed by the coiled tubing because of subsea currents, ocean heaving, and other dynamic oceanic phenomena that may act on the coiled tubing. Such dynamic oceanic phenomena is difficult, if not impossible, to predict or model. As a result, unknown fatigue may be introduced into coiled tubing when deployed in riser-less subsea operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to coiled tubing and, more particularly, to monitoring and mitigating the fatigue life of coiled tubing in riser-less subsea operations.

Embodiments of the present disclosure provide a real-time coiled tubing fatigue tracking method that can establish the remaining life of the coiled tubing. Each time coiled tubing is deployed, the coiled tubing incurs standard plastic fatigue in bending the coiled tubing from the reel and through a guide arch. According to the present disclosure, a fatigue tracking system is used to obtain dynamic fatigue measurements of the coiled tubing as the coiled tubing assumes strain forces due to interaction with an oceanic environment below a monitoring support guide that deploys the coiled tubing into the water. The monitoring support guide has a frame and at least two hydraulic rams, and sensors coupled to the at least two hydraulic rams may be configured to measure real-time lateral movement of the coiled tubing with respect to the monitoring support guide as the coiled tubing is deployed into the water. These measurements may be processed by a data acquisition system to determine real-time bending fatigue of the coiled tubing at select locations along the coiled tubing, and the real-time bending fatigue may be linked to specific locations along the length of the coiled tubing. As a result, an operator may be provided with a fatigue history file that maps the fatigue assumed by the coiled tubing at any given point along its length. As will be appreciated, this may prove advantageous in enabling coiled tubing life spans to be lengthened and optimized.

Figure 1:
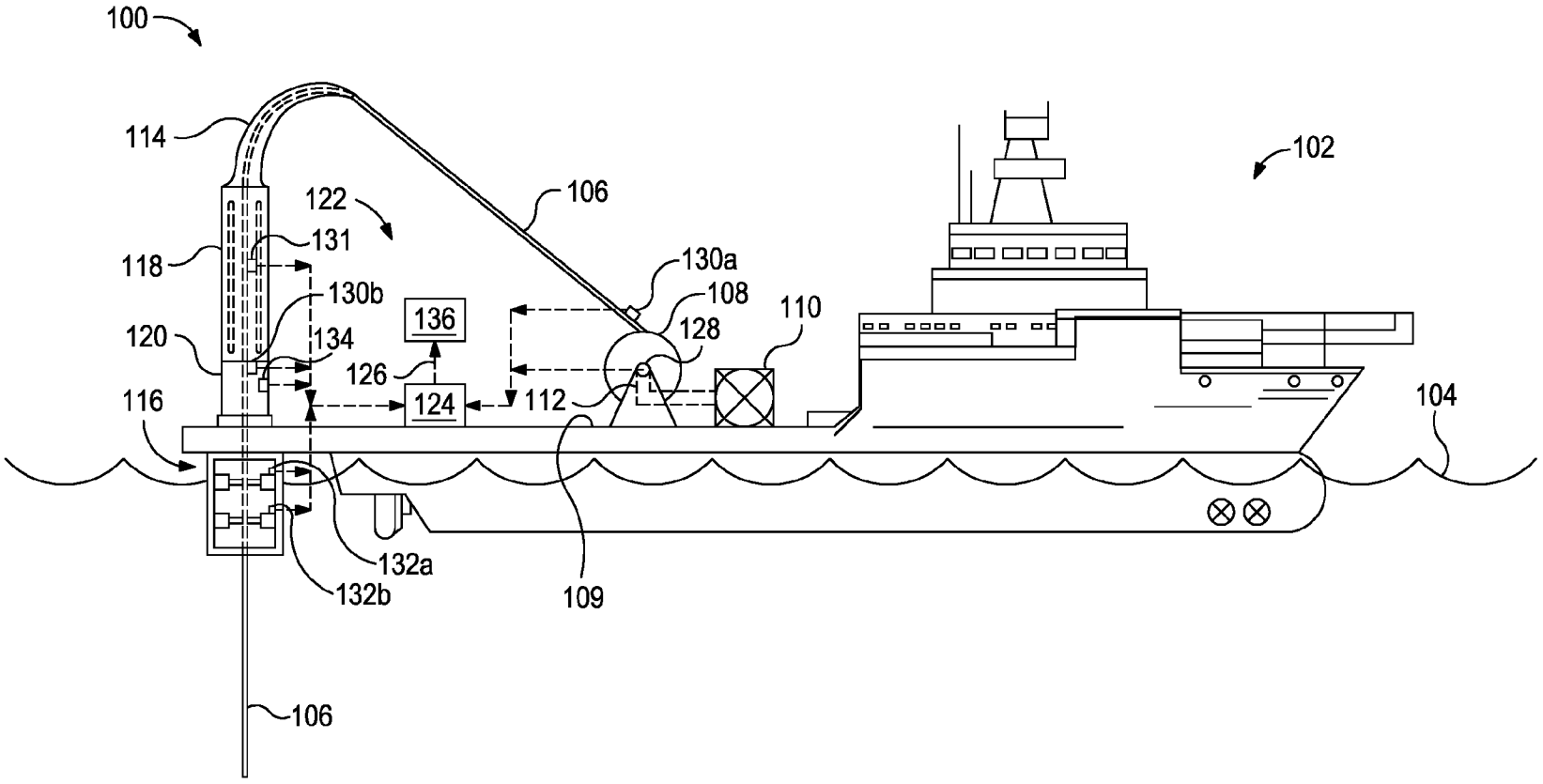
FIG. 1 is an exemplary coiled tubing deployment system that may employ the principles of the present disclosure.

Referring to FIG. 1, illustrated is an exemplary coiled tubing deployment system 100, according to one or more embodiments of the present disclosure. As illustrated, the coiled tubing deployment system 100 (hereafter "the system 100") may include or otherwise be used in conjunction with an offshore rig 102 configured to operate in an offshore environment including a body of water 104. In some embodiments, as illustrated, the offshore rig 102 may comprise a floating service vessel or boat. In other embodiments, however, the offshore rig 102 may comprise any offshore platform, structure, or vessel used in subsea intervention operations common to the oil and gas industry. The water 104 may comprise any body of water including, but not limited to, an ocean, a lake, a river, a stream, or any combination thereof.

The offshore rig 102 may be used to deploy coiled tubing 106 into the water 104 for various subsea purposes. In some cases, for instance, the coiled tubing 106 may be deployed for a well intervention operation where the coiled tubing 106 is coupled to and otherwise inserted into a subsea wellhead (not shown). In other embodiments, the coiled tubing 106 may comprise a conduit or umbilical used to convey fluids or power to a subsea location (not shown), such as a wellhead, a submerged platform, or a subsea pipeline. The coiled tubing 106 may be made of a variety of deformable materials including, but not limited to, a steel alloy, stainless steel, titanium, other suitable metal-based materials, thermoplastics, composite materials (e.g., carbon fiber-based materials), and any combination thereof. The coiled tubing 106 may exhibit a diameter of about 3.5 inches, but may alternatively exhibit a diameter that is greater or less than 3.5 inches, without departing from the scope of the disclosure.

The coiled tubing 106 may be deployed from a reel 108 positioned on the offshore rig 102, such as on a deck 109 of the offshore rig 102. The coiled tubing 106 may be wound multiple times around the reel 108 for ease of transport. In some embodiments, a fluid source 110 may be communicably coupled to the coiled tubing 106 via a fluid conduit 112 and configured to convey a pressurized fluid, such as a gas or a liquid, into the coiled tubing 106 for various purposes. As will be appreciated, the presence and amount (i.e., pressure) of the pressurized fluid may affect the mechanical strength of the coiled tubing 106. For instance, depending on whether the coiled tubing 106 is pressurized or not will determine how much bending can be caused in the coiled tubing 106 during operation; low fluid pressure will result in a first bending potential, while higher fluid pressure will result in a second bending potential.

The coiled tubing 106 may be fed from the reel 108 and into a guide arch 114, commonly referred to in the oil and gas industry as a "gooseneck." The guide arch 114 redirects the coiled tubing 106 toward a monitoring support guide 116 fixedly attached to the offshore rig 102. The guide arch 114 may comprise a rigid structure that exhibits a known radius. As the coiled tubing 106 is conveyed through the guide arch 114, the coiled tubing 106 may be plastically deformed and otherwise re-shaped and re-directed for receipt by the monitoring support guide 116 located there below.

The monitoring support guide 116 may be operatively coupled to the guide arch 114. As used herein, the term "operatively coupled" refers to a direct or indirect coupling engagement between component parts of the system 100. In some embodiments, for instance, the monitoring support guide 116 may be directly coupled to the guide arch 114. In other embodiments, however, the monitoring support guide 116 may be indirectly coupled to the guide arch 114 via one or more structural components that interposes the monitoring support guide 116 and the guide arch 114. In the illustrated example, for instance, an injector 118 and a support frame 120 may facilitate the operative coupling between the monitoring support guide 116 and the guide arch 114. In some embodiments, only one of the injector 118 and the support frame 120 may interpose the monitoring support guide 116 and the guide arch 114, without departing from the scope of the disclosure.

In some embodiments, as illustrated, the injector 118 may be secured to the offshore rig 102 and interpose the guide arch 114 and the monitoring support guide 116. In at least one embodiment, the support frame 120 may be included to couple the injector 118 to offshore rig 102. In operation, the injector 118 may be configured to advance or retract the coiled tubing 106, and thereby advance or retract the coiled tubing 106 within each of the guide arch 114 and the monitoring support guide 116. In some embodiments, for example, the injector 118 may include a plurality of internal gripping elements or wheels (not shown) configured to engage the outer surface of the coiled tubing 106 to either pull the coiled tubing 106 from the reel 108 and into the monitoring support guide 116, or retract the coiled tubing 106 from the water 104 to be wound again on the reel 108. In some embodiments, however, the injector 118 may be omitted and the weight of the coiled tubing 106 may instead be used for deployment and the reel 108 may be motorized to retract the coiled tubing 106.

The support frame 120 may be configured to transfer the weight assumed by the injector 118 to the deck 109 of the offshore rig 102 so that the deck 109 assumes at least a portion of the weight and torque applied by the coiled tubing 106. In embodiments where the injector 118 is omitted from the system 100, the support frame 120 may comprise a short structural component that is able couple the guide arch 114 to the deck 109 of the offshore rig 102.

As the coiled tubing 106 is unwound from the reel 108 and fed through the guide arch 114 and to the monitoring support guide 116, it is plastically deformed. This cycled bending is naturally repeated in reverse upon retracting the coiled tubing 106 to be wound back around the reel 108. In riser-less subsea applications, however, as shown in FIG. 1, additional forces and bending stresses can be assumed by the coiled tubing 106 as it enters the water 104. More particularly, in cases where the water 104 is open ocean, subsea currents, ocean heaving, waves, and other dynamic oceanic phenomena can all place strain and bending stress on the coiled tubing 106 as it is deployed and proceeds to greater depths in the water 104. Over time, these unpredictable bend cycles can induce considerable fatigue on the coiled tubing 106 through repeated stress and strain, ultimately affecting the overall useful life of the coiled tubing 106.

Bending forces and induced fatigue assumed by the coiled tubing 106 between the reel 108 and the injector 118 can be generally predicted and ascertained using known parameters, such as the diameter of the coiled tubing 106, the radius of the guide arch 114, and the pressure within the coiled tubing 106. Predicting the bending forces assumed by the coiled tubing 106 at or following the monitoring support guide 116, however, can be less certain in view of the unpredictable dynamic environment of the water 104, which provides essentially no known variables. According to embodiments of the present disclosure, the bending forces assumed by the coiled tubing 106 at or following the monitoring support guide 116 may be monitored and quantified in real-time and those measurements may be mapped along the length of the coiled tubing 106 to determine fatigue life of the coiled tubing 106. Moreover, the monitoring support guide 116 may operate to mitigate the bending forces assumed by the coiled tubing 106 at or following the monitoring support guide 116, and thereby prolong its useful life.

To monitor the bending and fatigue of the coiled tubing 106 in real-time, the system 100 may include a fatigue tracking system 122. The fatigue tracking system 122 may provide a reliable method for establishing and recording, both in real-time and in memory mode, the bending forces that are assumed by the coiled tubing 106 at or near the monitoring support guide 116 and otherwise in the region around the interface with the water 104. As described below, the fatigue tracking system 122 may be configured to record the resultant forces and bending levels encountered by the coiled tubing 106 and link those measurements back to the location in the coiled tubing 106 where the forces were assumed. As a result, induced fatigue and the corresponding level of bending for each section of the coiled tubing 106 conveyed through the system 100 may be established and mapped back into a fatigue history file for the coiled tubing 106. Once segments of the coiled tubing 106 begin to reach predetermined fatigue limits as based on the fatigue history file, an operator may consider retiring the coiled tubing 106 to avoid failure.

As illustrated, the fatigue tracking system 122 may include a plurality of sensors and devices, each communicably coupled to a data acquisition system 124 configured to receive and process signals deriving from each sensor and/or device. The data acquisition system 124 may be a computer system, for example, that includes a memory, a processor, and computer readable instructions that, when executed by the processor, process the sensor and device signals to provide an output signal 126. Data corresponding to the construction parameters of the coiled tubing 106 may be provided to the data acquisition system 124 for reference. For instance, construction parameters of the coiled tubing 106 loaded into the data acquisition system 124 may include material grade, length, outer diameter, and inner diameter of the coiled tubing 106. Additional construction parameters that may be loaded into the data acquisition system 124 include the location of segment welds or joints along the body of the coiled tubing 106. The construction parameters may be used by the data acquisition system 124 as reference points in generating the fatigue history file for the coiled tubing 106.

The fatigue tracking system 122 may further include a pressure sensor 128 used to measure the real-time pressure within the coiled tubing 106 during operation. The pressure sensor 128 may be fluidly coupled to the coiled tubing 106 and, more particularly, communicably coupled to the coiled tubing 106 at the fluid conduit 112, which, as mentioned above, provides pressurized fluid into the coiled tubing 106 from the fluid source 110. The real-time pressure detected by the pressure sensor 128 may be conveyed to the data acquisition system 124 for processing and in helping to determine fatigue of the coiled tubing 106. More particularly, the data acquisition system 124 may take into consideration the detected pressure in calculating fatigue on the coiled tubing 106 since the internal pressure may affect the mechanical strength of the coiled tubing 106.

In the illustrated embodiment, the fatigue tracking system 122 may also include a depth counter 130 located at a fixed point relative to the coiled tubing 106 and otherwise along the path traversed by the coiled tubing 106 through the system 100. In some embodiments, the depth counter 130 may be located at or immediately after the reel 108, as shown by a first depth counter 130*a*. In other embodiments, however, the depth counter 130 may be located immediately below the injector 118 and otherwise prior to the monitoring support guide 116, as shown by a second depth counter 130*b*. The depth counter 130 may comprise any measurement device capable of monitoring how much length of the coiled tubing 106 is deployed from the reel 108 and bypasses the depth counter 130. In some embodiments, for instance, the depth counter 130 may be a depth wheel that physically engages the coiled tubing 106 while it moves to register the traversed length or distance. In other embodiments, however, the depth counter 130 may comprise an optical measurement device, such as a laser sight capable of converting optical images into distance measurements.

Measurements obtained by the depth counter 130 may be conveyed to the data acquisition system 124 for processing and may be used by the data acquisition system 124 to map the coiled tubing 106 and correlate specific real-time strain or bend measurements with the precise location where such forces are assumed by the coiled tubing 106. Moreover, the measured distance or length may be mapped over time and correlated to material fatigue at known location along the coiled tubing 106, which form part of the fatigue history file for the coiled tubing 106.

The fatigue tracking system 122 may further include a transducer or weight sensor 131 that is used to measure the real-time surface weight of the coiled tubing 106 during the operation. The weight sensor 131 may be coupled indirectly to the coiled tubing 106 and, more particularly, via the design of the frame of the injector 118. In embodiments where the injector 118 is omitted, the weight sensor 131 may be coupled via a mechanism (not shown) that transfers the weight of the coiled tubing 106 onto the deck 109. Such a mechanism may comprise, for example, a work window into which a set of slip rams can be used to hold stationary the coiled tubing 106 or via a load cell located below the guide arch 114. The real-time weight measurements detected by the weight sensor 131 may be conveyed to the data acquisition system 124 for processing and the data acquisition system 124 may take into consideration the detected weight in calculating fatigue on the coiled tubing 106.

The fatigue tracking system 122 may further include a first set of sensors 132*a* located at a first location on the monitoring support guide 116 and a second set of sensors 132*a* located at a second location on the monitoring support guide 116, where the first and second locations are axially offset from each other. As described in more detail below, the first and second sets of sensors 132*a,b* may be configured to measure real-time strain assumed by the coiled tubing 106 as it is deployed into the water 104. Sensor signals derived from the first and second sets of sensors 132*a,b* may be conveyed to the data acquisition system 124 for processing. In at least one embodiment, however, the second set of sensors 132*b* may be omitted from the fatigue tracking system 122, without departing from the scope of the disclosure.

In at least one embodiment, the fatigue tracking system 122 may further include a set of reference sensors 134 located at a fixed surface point, such as just above the monitoring support guide 116 and otherwise above the anticipated critical bending point in the coiled tubing 106. The reference sensors 134 may include a strain sensor and an accelerometer, and sensor signals derived from the reference sensors 134 may be conveyed to the data acquisition system 124 for processing. The reference sensors 134 may be configured to monitor and detect heave and movement of the surface vessel 102 during operation, and thereby provide a reference point for the measurements obtained by the first and second sets of sensors 132*a,b* of the monitoring support guide 116. In the illustrated embodiment, the reference sensors 134 are depicted as being coupled to the support frame 120, but may equally be coupled at any fixed point above the monitoring support guide 116 following the guide arch 114, without departing from the scope of the disclosure. In some embodiments, the strain sensor may be located prior to the monitoring support guide 116 and after the guide arch 114, while the accelerator may be fixedly attached anywhere on the offshore rig 102 to detect the heave and movement of the offshore rig 102 during operation.

Figure 2:
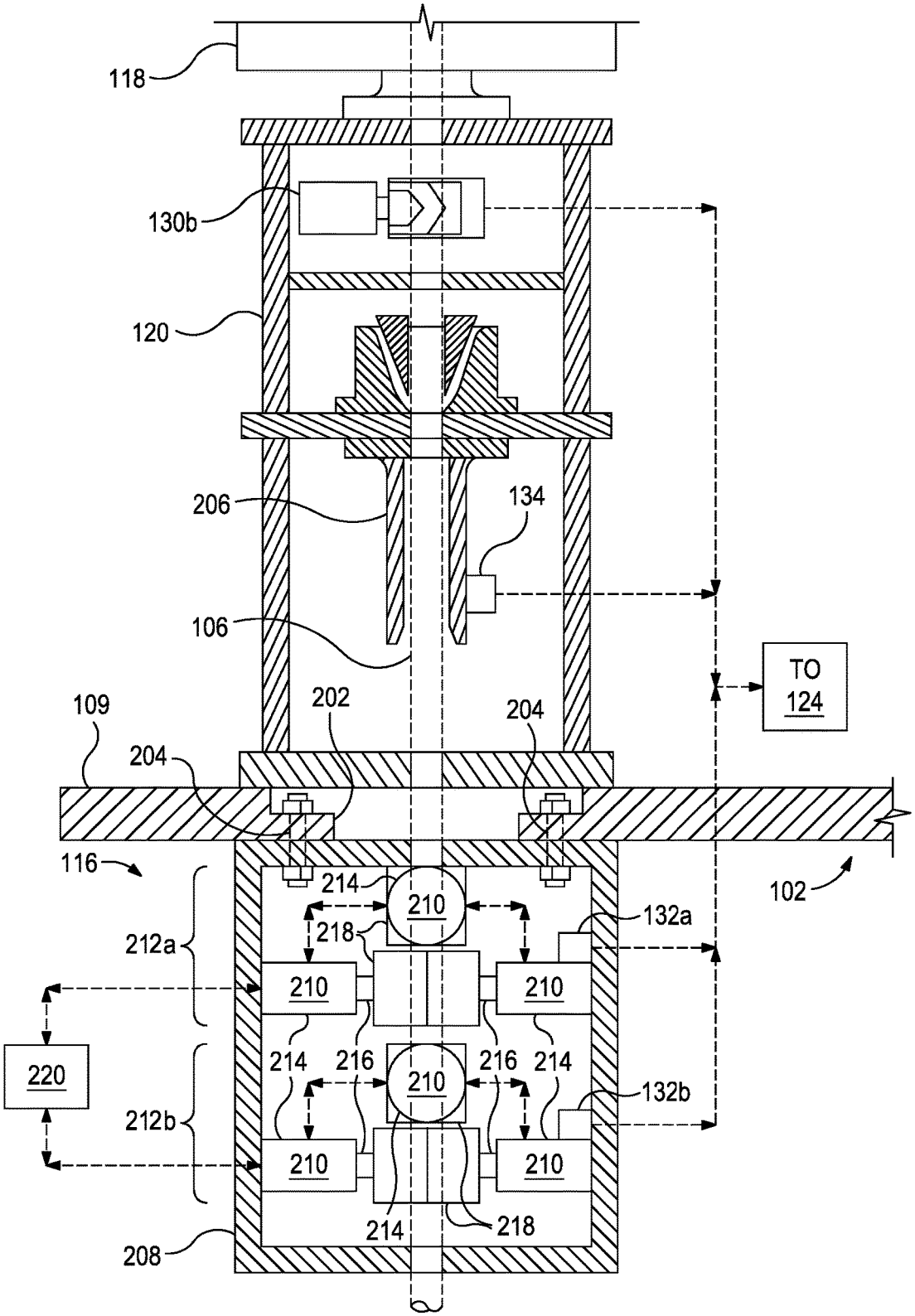
FIG. 2 is an enlarged partial cross-sectional side view of the monitoring support guide of FIG. 1.

Referring now to FIG. 2, with continued reference to FIG. 1, illustrated is an enlarged partial cross-sectional side view of the monitoring support guide 116, according to one or more embodiments of the present disclosure. Like numerals from FIG. 1 that are used in FIG. 2 refer to the same elements or components, and may not be described again in detail. As illustrated, the monitoring support guide 116 may be fixedly attached to the offshore rig 102 and, more particularly, coupled to a portion of the deck 109 of the offshore rig 102. It will be appreciated, however, that the monitoring support guide 116 may be alternatively secured to the offshore rig 102 in a variety of other ways, without departing from the scope of the disclosure. For instance, in at least one embodiment, the offshore rig 102 may include a moon pool (not shown) and the monitoring support guide 116 may be secured to the offshore rig 102 at or near the moon pool such that the coiled tubing 106 is deployable into the water 104 via the moon pool.

In the illustrated embodiment, the deck 109 may provide and otherwise define a hole 202 that extends through the deck 109, and the monitoring support guide 116 may be coupled to the underside of the deck 109 and aligned with the hole 109 to receive the coiled tubing 106 from the support frame 120. Mechanical fasteners 204, such as a plurality of nut and bolt arrangements, may be used to couple the monitoring support guide 116 to the offshore rig 102. In other embodiments, however, the monitoring support guide 116 may alternatively be coupled to the top-side of the deck 109 and convey the coiled tubing 106 into the water 104 via the hole 202, without departing from the scope of the disclosure.

The support frame 120 may operate as a work window that facilitates access to the coiled tubing 106. A topside guide 206 may be located in the support frame 120 and used to centralize the coiled tubing 106 for receipt by the monitoring support guide 116 via the hole 202. The support frame 120 may be configured to transfer the weight assumed by the injector 118 to the deck 109 of the offshore rig 102 so that the deck 109 assumes the weight over time. In embodiments where the injector 118 is omitted, the support frame 120 may comprise a short component that is able to couple the guide arch 114 to the deck 109 of the offshore rig 102. In the illustrated embodiment, a further depth counter 130*b* is depicted as being located immediately below the injector 118 and otherwise prior to the monitoring support guide 116. As indicated above, measurements obtained by the depth counter 130*b* may be conveyed to the data acquisition system 124 for processing to map the coiled tubing 106 with respect to fatigue.

The set of reference sensors 134 is also depicted in FIG. 2 and shown as being positioned on the topside guide 206. The measurements obtained by the reference sensors 134 (e.g., reference sensor signals) may be conveyed to the data acquisition system 124 and provide a control point or reference offset that may be applied to the measurements of the first set of sensors 132*a* (and optionally the measurements derived from the second set of sensors 132*b*, if used). More particularly, the data acquisition system 124 may apply the measurements derived from the reference sensors 134 to the first set of sensors 132*a* (and optionally the measurements derived from the second set of sensors 132*b*, if used) to remove the motion of the surface vessel 102 and the stresses created from bending assumed above the monitoring support guide 116. Accordingly, in at least one embodiment, the data acquisition system 124 may process the sensor signals derived from the first set of sensors 132*a* in view of reference measurements derived from the reference sensors 134.

The monitoring support guide 116 may be configured to stabilize the coiled tubing 106 at a critical point of high stress assumed by the coiled tubing. As illustrated, the monitoring support guide 116 may include a frame 208 and a plurality of hydraulic rams 210 secured to the frame 208 and actuatable to engage and stabilize the coiled tubing 106. In the illustrated embodiment, the hydraulic rams 210 are segregated into a first stabilizing module 212*a* and a second stabilizing module 212*b*, where the first and second stabilizing modules 212*a,b* are axially offset from each other within the frame 208. While the monitoring support guide 116 is depicted as including two stabilizing modules 212*a,b*, it will be appreciated that more or less than two stabilizing modules 212*a,b* may be employed, including applications where a single stabilizing module is employed, without departing from the scope of the disclosure.

Each stabilizing module 212*a,b* may include at least two hydraulic rams 210 angularly offset from each other about the coiled tubing 106. In the illustrated embodiment, two hydraulic rams 210 are depicted as being angularly offset from each other by 180°, and shown in FIG. 2 as extending to the left and the right on opposing sides of the coiled tubing 106. In other embodiments, however, other arrangements of the hydraulic rams 210 may alternatively be employed, such as having three hydraulic rams 210 angularly offset from each other by 120° intervals, without departing from the scope of the disclosure.

In some embodiments, one or both of the stabilizing modules 212*a,b* may include two additional hydraulic rams 210, shown in FIG. 2 as extending into and out of the page (only one hydraulic ram 210 is shown as the other is hidden going into the page). These two additional rams 210 may also be angularly offset from each other by 180°, but further angularly offset from the first two hydraulic rams 210 by 45°. Accordingly, in such embodiments, the hydraulic rams 210 of each stabilizing module 212*a,b* may surround the coiled tubing at 45° intervals. In other embodiments, however, and similar to the first set of hydraulic rams 210, the second set of hydraulic rams 210 may alternatively include three hydraulic rams 210 angularly offset from each other at 120° intervals, without departing from the scope of the disclosure.

In the illustrated embodiment, the four hydraulic rams 210 of each stabilizing module 212*a,b* are depicted as being separated into two sets of opposing hydraulic rams 210 that are axially offset from each other a short distance along the coiled tubing 106. In other embodiments, however, the four hydraulic rams 210 of one or both of the stabilizing modules 212*a,b* may be arranged in the same axial plane, without departing from the scope of the disclosure.

Each hydraulic ram 210 may include a piston cylinder 214 and a piston 216 movable in and out of the piston cylinder 214 to stabilize the coiled tubing 106. The pistons 216 may be fully retractable and thereby allow recovery of tool strings (not shown) coupled to the coiled tubing 206. In some embodiments, the pistons 216 may directly engage the outer surface of the coiled tubing 106 during operation. In other embodiments, however, the pistons 216 may engage a contact block 218 interposing the coiled tubing 106 and each piston 216. In some embodiments, as illustrated, the contacts blocks 218 may comprise half-blocks configured to receive the coiled tubing 206. The contact blocks 218 may be configured to receive and protect the coiled tubing 106 from point loading caused by opposing pistons 216, which could result in localized damage to the coiled tubing 106. Moreover, using the contact blocks 218 may provide a larger surface area to contact and stabilize the coiled tubing 106, whereby bending loads and stresses assumed by the coiled tubing 106 may be spread over the larger surface area.

In the illustrated embodiment, each piston 216 may engage a separate contact block 218 and some contact blocks 218 may be axially offset from each other a short distance along the coiled tubing 106. In embodiments where the hydraulic rams 210 of the stabilizing module 212*a,b* are all arranged in the same axial plane, however, the pistons 216 of each set of opposing hydraulic rams 210 may engage contact blocks 218 aligned in the same axial plane, without departing from the scope of the disclosure.

As illustrated, the first set of sensors 132*a* is depicted as being associated with the hydraulic rams 210 of the first stabilizing module 212*a*, and the second set of sensors 132*a* is depicted as being associated with the hydraulic rams 210 of the second stabilizing module 212*b*. The first and second sets of sensors 132*a,b* may each comprise one or more sensors used to monitor operation of the corresponding hydraulic rams 210 and thereby measure and record real-time lateral movement of the coiled tubing 106 with respect to the monitoring support guide 116. Sensor signals derived from the first and second sets of sensors 132*a,b* may be conveyed to the data acquisition system 124 for processing to determine the amount of bend or fatigue assumed by the coiled tubing 106 at that location.

In some embodiments, one or both of the first and second sets of sensors 132*a,b* may include a pressure transducer communicably coupled to one or all of the piston cylinders 214 to measure real-time pressure fluctuations of a hydraulic fluid used in the hydraulic rams 210. An increase in fluid pressure in a given hydraulic ram 210 may be an indication of lateral movement of the coiled tubing 106 toward the given hydraulic ram 210. More particularly, dynamic movement of the water 104 (FIG. 1) may act on the coiled tubing 106, which may force the coiled tubing 106 to move laterally with respect to the monitoring support guide 116 and act on the piston 216 of a given hydraulic ram 210. The pressure transducer may be configured to measure the resulting increase in fluid pressure as the piston 216 is forced to retract into the piston cylinder 214. Each hydraulic ram 210 may have a known ram area and the measured pressure increase, in combination with the known ram area, may be correlated to the amount of bending force applied on the coiled tubing 106 at that point.

In other embodiments, one or both of the first and second sets of sensors 132*a,b* may include a flowmeter communicably coupled to one or all of the hydraulic rams 210 to measure real-time flow rates of the hydraulic fluid, which can be used to determine bending fatigue on the coiled tubing 106. More particularly, when the coiled tubing 106 moves laterally with respect to the monitoring support guide 116 and acts on a given hydraulic ram 210, hydraulic fluid behind the corresponding piston 216 may be displaced through the flowmeter. The magnitude of the flow rate measured by the flowmeter, in combination with the known ram area, may correspond to the amount of bending force applied on the coiled tubing 106 at that point.

In yet other embodiments, one or both of the first and second sets of sensors 132*a,b* may include a movement sensor coupled to one or all of the hydraulic rams 210 to measure axial translation of the corresponding pistons 216, which can be used to determine bending fatigue on the coiled tubing 106. More particularly, the movement sensor may be arranged to measure the distance traveled by the piston 216 when the coiled tubing 106 moves laterally with respect to the monitoring support guide 116 and acts on the piston 216 of a given hydraulic ram 210. The distance measured is directly proportional to the real-time lateral movement of the coiled tubing 106 and, therefore, may be correlated to the amount of bending force applied on the coiled tubing 106 at that point.

As will be appreciated, the first and second sets of sensors 132*a,b* may comprise any or all of the aforementioned pressure transducers, flowmeters, and movement sensors in any combination. It may prove advantageous to have all three types of sensors for redundancy or allowing the data acquisition system to average the calculated amount of bending force applied on the coiled tubing 106 as measured by each type of sensor.

In some embodiments, the hydraulic rams 210 of one or both of the stabilizing modules 212*a,b* may be communicably coupled to a control system 220 used to operate the hydraulic rams 210. In operation, the control system 220 may regulate the hydraulic fluid pressure within each hydraulic ram 210 and thereby help balance the forces against the coiled tubing 106. In at least one embodiment, the control system 220 may be programmed to maintain the hydraulic rams 210 in a position such that the coiled tubing 106 remains axially aligned along the length of the monitoring support guide 116. In other embodiments, or in addition thereto, the control system 220 may be programmed to counteract lateral movement of the coiled tubing 106 by selectively increasing the pressure of the hydraulic rams 210 being acted upon by the coiled tubing 106. Accordingly, the monitoring support guide 116 may serve to steady the coiled tubing 106 during operation and thereby mitigate or prevent potential bending fatigue that may have otherwise occurred.

In yet other embodiments, the control system 220 may allow a user to selectively modify the fluid pressure in each hydraulic ram 210 to accommodate different applications. For instance, in some applications it may be desired to have less lateral movement of the coiled tubing 106 during deployment as compared to other applications. In such applications, the fluid pressure in the hydraulic rams 210 may be managed via a valve arrangement to reduce or prevent the amount of lateral movement of the coiled tubing 106 past a predetermined bend threshold. By reducing the lateral movement of the coiled tubing 106, the stress assumed by the coiled tubing 106 may correspondingly be reduced at that point. In other applications, it may be desired to allow additional lateral movement of the coiled tubing 106, which may mitigate excess bending fatigue. In such applications, the fluid pressure and flow in the hydraulic rams 210 may be managed via a valve arrangement. Consequently, the control system 220 may be used to optimize the amount of hydraulic fluid pressure applied by each set of hydraulic rams 210, and thereby provide an optimizable stabilizing effect on the coiled tubing 106.

Opposing hydraulic rams 210 in either of the stabilizing modules 212*a,b* may be fluidly coupled via a common fluid circuit. When the coiled tubing 106 moves laterally with respect to the monitoring support guide 116 and acts on one hydraulic ram 210, hydraulic fluid behind the piston 216 may be displaced through the fluid circuit to the opposing hydraulic ram 210, and thereby place a hydraulic load on the piston 216 of the opposing hydraulic ram 210. As a result, when one hydraulic ram 210 moves, the opposing hydraulic ram 210 receives the displaced hydraulic fluid and may correspondingly move such that a tight engagement with the coiled tubing 106 is maintained (e.g., through the corresponding contact block 218). As will be appreciated, this may prove advantageous in suppressing lateral movement of the coiled tubing 106 and otherwise stabilizing the coiled tubing 106.

Referring again to FIG. 1, each of the sensors 128, 131, 132*a,b*, 134 and the depth counter 130 may be communicably coupled to the data acquisition system 124 and configured to transmit corresponding measurement signals thereto in real-time via any known means of telecommunication or data transmission. In some embodiments, for instance, the data acquisition system 124 may be physically wired to one or more of the sensors 128, 131, 132*a,b*, 134 and the depth counter 130 such as through electrical or fiber optic lines. In other embodiments, however, one or more of the sensors 128, 131, 132*a,b*, 134 and the depth counter 130 may be configured to wirelessly communicate with the data acquisition system 124, such as via electromagnetic telemetry, acoustic telemetry, ultrasonic telemetry, radio frequency transmission, or any combination thereof.

In some embodiments, as illustrated, the data acquisition system 124 may be arranged on the offshore rig 102. In other embodiments, however, the data acquisition system 124 may be remotely located and the sensors 128, 131, 132*a,b*, 134 and the depth counter 130 may be configured to communicate remotely with the data acquisition system 124 (either wired or wirelessly). The data acquisition system 124 may be configured to receive and process the various signals from the sensors 128, 131, 132*a,b*, 134 and the depth counter 130 in conjunction with the construction parameters of the coiled tubing 106. The relative distances between the sensors 128, 131, 132*a,b*, 134 and the depth counter 130 may also be used as configurable parameters within the data acquisition system 124 in generating the output signal 126.

The output signal 126 may comprise real-time bending data corresponding to specific locations along the length of the coiled tubing 106. In some embodiments, such data may be stored for future reference or consideration. In other embodiments, however, the output signal 126 may be conveyed to a peripheral device 136 for consideration and/or review by an operator in real-time. The peripheral device 136 may include, but is not limited to, a monitor (e.g., a display, a GUI, a handheld device, a tablet, etc.), a printer, an alarm, additional storage memory, or any combination thereof. In some embodiments, the peripheral device 136 may be configured to provide the operator with a graphical output or display that charts or maps the length of the coiled tubing 106 versus estimated fatigue on the coiled tubing 106 at any given location. Accordingly, given that fatigue life of the coiled tubing 106 is largely a matter of repeated usage, the data acquired by the data acquisition system 124 may be stored and historically tied to the specific coiled tubing 106 and thereby form part of the fatigue history file corresponding to the coiled tubing 106.

Figure 3:
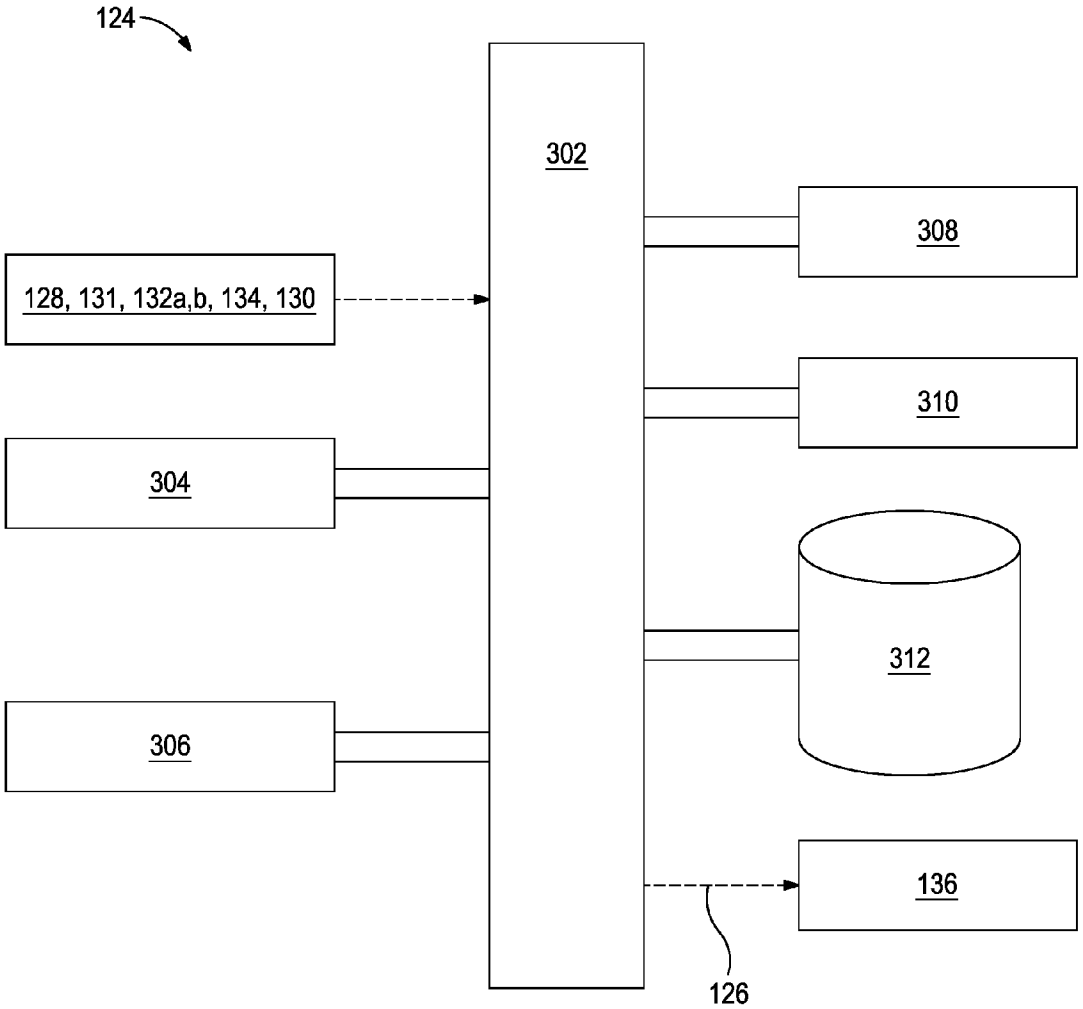
FIG. 3 is a block diagram of the data acquisition system of FIG. 1.

Referring now to FIG. 3, with continued reference to FIG. 1, illustrated is a block diagram of the data acquisition system 124, according to one or more embodiments. As illustrated, the data acquisition system 124 may include a bus 302, a communications unit 304, one or more controllers 306, a non-transitory computer readable medium (i.e., a memory) 308, a computer program 310, and a library or database 312. The bus 302 may provide electrical conductivity and a communication pathway among the various components of the data acquisition system 124. The communications unit 304 may employ wired or wireless communication technologies, or a combination thereof. The communications unit 304 can include communications operable among land locations, sea surface locations both fixed and mobile, and undersea locations both fixed and mobile. The computer program 310 may be stored partially or wholly in the memory 308 and, as generally known in the art, it may be in the form of microcode, programs, routines, or graphical programming.

In exemplary operation, the data acquisition system 124 receives and samples one or more signals derived from the sensors 128, 131, 132*a,b*, 134 and the depth counter 130. The controller 306 may be configured to transfer the sensor signals to the memory 308, which may encompass at least one of volatile or non-volatile memory. The computer program 310 may be configured to access the memory 308 and process the sensor signals in real-time. In some embodiments, however, the sensor signals may be logged or otherwise stored in the memory 308 or the database 312 for post-processing review or analysis.

In processing the sensor signals, the computer program 310 may be configured to digitize the sensor signal and generate digital data. The computer program 310 may employ pre or post-acquisition processing by applying one or more signal amplifiers and/or signal filters (e.g., low, medium, and/or high-pass frequency filters) in hardware or software. In some embodiments, the computer program 310 may be configured to output the acquired signal in the time domain, thereby providing a time domain output. In another embodiment, the computer program 310 may also be capable of transforming and outputting the digital data in the frequency domain, thereby providing a frequency domain output. This transformation into the frequency domain may be accomplished using several different frequency-based processing methods including, but not limited to, fast Fourier transforms (FFTs), short-time Fourier transforms (STFTs), wavelets, the Goertzel algorithm, or any other domain conversion methods or algorithms known by those skilled in the art. In some embodiments, one or both of the time domain and frequency domain signals may be filtered using at least one of a low-pass filter, a medium-pass filter, and a high-pass filter or other types of filtering techniques, without departing from the scope of the disclosure.

The computer program 310 may further be configured to query the database 312 for stored data corresponding to construction parameters of the coiled tubing 106 and relative distances between the sensors 128, 131, 132*a,b*, 134 and the depth counter 130. Upon querying the database 312, the computer program 310 may be able to apply the construction parameters and relative distances to the measured signals. The computer program 310 may then deliver the output signal 126 comprising real-time bending data corresponding to specific locations along the length of the coiled tubing 106. In some cases, as indicated above, the output signal 126 may be provided to the peripheral device 136 for display. In other embodiments, or in addition thereto, the data acquired by the data acquisition system 124 may be stored and historically tied to the fatigue history file corresponding to the coiled tubing 106.

Embodiments disclosed herein include:

A. A coiled tubing deployment system that includes an offshore rig having a reel positioned thereon and coiled tubing wound on the reel, the offshore rig being deployable on water, a guide arch positioned on the offshore rig to receive the coiled tubing from the reel, a monitoring support guide fixed to the offshore rig and operatively coupled to the guide arch to receive and direct the coiled tubing into the water, the monitoring support guide having a frame and at least two hydraulic rams secured to the frame and angularly offset from each other, wherein each hydraulic ram includes a piston cylinder and a piston movable in and out of the piston cylinder, a depth counter positioned at a fixed point relative to the coiled tubing to measure a length of the coiled tubing deployed from the reel and to generate one or more length measurement signals, a weight sensor positioned at a fixed point relative to the coiled tubing to measure a weight of the coiled tubing and to generate one or more weight measurement signals, one or more sensors coupled to the at least two hydraulic rams to measure real-time lateral movement of the coiled tubing with respect to the monitoring support guide as the coiled tubing is deployed into the water and thereby generate one or more sensor signals, and a data acquisition system that receives and processes the one or more length measurement signals, the one or more weight measurement signals, and the one or more sensor signals, the data acquisition system providing an output signal indicative of real-time bending fatigue of the coiled tubing at select locations along the coiled tubing.

B. A method that includes deploying coiled tubing from a reel positioned on an offshore rig and receiving the coiled tubing with a guide arch positioned on the offshore rig, receiving the coiled tubing from the guide arch with a monitoring support guide fixed to the offshore rig and conveying the coiled tubing into water below the offshore rig from the monitoring support guide, the monitoring support guide having a frame and at least two hydraulic rams secured to the frame and angularly offset from each other, wherein each hydraulic ram includes a piston cylinder and a piston movable in and out of the piston cylinder, measuring a length of the coiled tubing deployed from the reel with a depth counter positioned at a fixed point relative to the coiled tubing and thereby generating one or more length measurement signals, measuring a weight of the coiled tubing with a weight sensor positioned at a fixed point relative to the coiled tubing and thereby generating one or more weight measurement signals, measuring real-time lateral movement of the coiled tubing with respect to the monitoring support guide as deployed into the water with one or more sensors coupled to the at least two hydraulic rams and thereby generating one or more sensor signals, receiving and processing the one or more length measurement signals, the one or more weight measurement signals, and the one or more sensor signals with a data acquisition system communicably coupled to the depth counter and the one or more sensors, and generating an output signal with the data acquisition system indicative of real-time bending fatigue of the coiled tubing at select locations along the coiled tubing.

Each of embodiments A and B may have one or more of the following additional elements in any combination: Element 1: wherein the at least two hydraulic rams comprise four hydraulic rams angularly offset from each other about the coiled tubing by 45°. Element 2: wherein the four hydraulic rams comprise two first opposing hydraulic rams and two second opposing hydraulic rams, and wherein the first and second opposing hydraulic rams are axially offset from each other. Element 3: wherein the at least two hydraulic rams form part of a first stabilizing module and the monitoring support guide further includes a second stabilizing module axially offset from the first stabilizing module and having at least two additional hydraulic rams secured to the frame and angularly offset from each other. Element 4: further comprising one or more contact blocks interposing the coiled tubing and each piston, wherein each piston engages a corresponding contact block in stabilizing the coiled tubing. Element 5: further comprising an injector that interposes the guide arch and the monitoring support guide. Element 6: further comprising a support frame that couples the injector to the monitoring support guide. Element 7: wherein the one or more sensors comprises a pressure transducer communicably coupled to the at least two hydraulic rams to measure real-time pressure fluctuations of a hydraulic fluid as the coiled tubing acts on the hydraulic rams. Element 8: wherein the one or more sensors comprises a flowmeter communicably coupled to the at least two hydraulic rams to measure real-time flow rates of a hydraulic fluid as the coiled tubing acts on the hydraulic rams. Element 9: wherein the one or more sensors comprises a movement sensor coupled to the at least two hydraulic rams to measure axial translation of the pistons as the coiled tubing acts on the hydraulic rams. Element 10: further comprising a control system communicably coupled to the at least two hydraulic rams for regulating a hydraulic fluid pressure within each hydraulic ram. Element 11: wherein construction parameters for the coiled tubing are stored in a memory of the data acquisition system, and wherein the construction parameters are used to determine the real-time bending fatigue of the coiled tubing. Element 12: further comprising a pressure sensor fluidly coupled to the coiled tubing to obtain real-time pressure measurements within the coiled tubing, wherein the data acquisition system receives and processes the real-time pressure measurements in determining the real-time bending fatigue of the coiled tubing. Element 13: further comprising a set of reference sensors coupled to the offshore rig at a fixed surface point to monitor and detect heave and movement of the offshore rig and generate corresponding reference signals, wherein the data acquisition system receives and processes the corresponding reference signals to remove motion effects of the offshore rig from the one or more sensor signals in determining the real-time bending fatigue of the coiled tubing. Element 14: further comprising a peripheral device communicably coupled to the data acquisition system to receive the output signal and provide a graphical output corresponding to the real-time bending fatigue of the coiled tubing at the select locations along the coiled tubing.

Element 15: wherein the one or more sensors comprises a pressure transducer communicably coupled to the at least two hydraulic rams, and wherein measuring the real-time lateral movement of the coiled tubing comprises measuring real-time pressure fluctuations of a hydraulic fluid with the pressure transducer as the coiled tubing acts on the hydraulic rams. Element 16: wherein the one or more sensors comprises a flowmeter communicably coupled to the at least two hydraulic rams, and wherein measuring the real-time lateral movement of the coiled tubing comprises measuring real-time flow rates of a hydraulic fluid with the flowmeter as the coiled tubing acts on the hydraulic rams. Element 17: wherein the one or more sensors comprises a movement sensor communicably coupled to the at least two hydraulic rams, and wherein measuring the real-time lateral movement of the coiled tubing comprises measuring axial translation of the pistons with the movement sensor as the coiled tubing acts on the hydraulic rams. Element 18: further comprising regulating a hydraulic fluid pressure within each hydraulic ram with a control system communicably coupled to the at least two hydraulic rams. Element 19: wherein construction parameters for the coiled tubing are stored in a memory of the data acquisition system, the method further comprising accessing using the construction parameters in determining the real-time bending fatigue of the coiled tubing. Element 20: further comprising obtaining real-time pressure measurements within the coiled tubing with a pressure sensor fluidly coupled to the coiled tubing, and receiving and processing the real-time pressure measurements with the data acquisition system in determining the real-time bending fatigue of the coiled tubing. Element 21: further comprising monitoring and detecting heave and movement of the offshore rig with a set of reference sensors coupled to the offshore rig at a fixed surface point, generating reference signals with the set of reference sensors indicative of real-time heave and movement of the offshore rig, and receiving and processing the reference signals with the data acquisition system and thereby removing motion effects of the offshore rig from the one or more sensor signals in determining the real-time bending fatigue of the coiled tubing. Element 22: further comprising receiving the output signal with a peripheral device communicably coupled to the data acquisition system, and generating a graphical output corresponding to the real-time bending fatigue of the coiled tubing at the select locations along the coiled tubing. Element 23: wherein generating the graphical output comprises generating a map of the coiled tubing versus estimated fatigue on the coiled tubing at select locations along the coiled tubing. Element 24: further comprising mapping the coiled tubing with the data acquisition system to obtain a fatigue history file for the coiled tubing.

By way of non-limiting example, exemplary combinations applicable to A and B include: Element 1 with Element 2; Element 5 with Element 6; and Element 22 with Element 23.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A coiled tubing deployment system, comprising:

an offshore rig having a reel positioned thereon and coiled tubing wound on the reel, the offshore rig being deployable on water;

a guide arch positioned on the offshore rig to receive the coiled tubing from the reel;

a monitoring support guide fixed to the offshore rig and operatively coupled to the guide arch to receive and direct the coiled tubing into the water, the monitoring support guide having a frame and at least two hydraulic rams secured to the frame and angularly offset from each other, wherein each hydraulic ram includes a piston cylinder and a piston movable in and out of the piston cylinder;

a depth counter positioned at a first fixed point relative to the coiled tubing to measure a length of the coiled tubing deployed from the reel and to generate one or more length measurement signals;

a weight sensor positioned at a second fixed point relative to the coiled tubing to measure a weight of the coiled tubing and to generate one or more weight measurement signals;

one or more sensors coupled to the at least two hydraulic rams to measure real-time lateral movement of the coiled tubing with respect to the monitoring support guide as the coiled tubing is deployed into the water and thereby generate one or more sensor signals; and a data acquisition system that receives and processes the one or more length measurement signals, the one or more weight measurement signals, and the one or more sensor signals, the data acquisition system providing an output signal indicative of real-time bending fatigue of the coiled tubing at select locations along the coiled tubing.

2. The coiled tubing deployment system of claim 1, wherein the at least two hydraulic rams comprise four hydraulic rams angularly offset from each other about the coiled tubing by 45°.

3. The coiled tubing deployment system of claim 2, wherein the four hydraulic rams comprise two first opposing hydraulic rams and two second opposing hydraulic rams, and wherein the first and second opposing hydraulic rams are axially offset from each other.

4. The coiled tubing deployment system of claim 1, wherein the at least two hydraulic rams form part of a first stabilizing module and the monitoring support guide further includes a second stabilizing module axially offset from the first stabilizing module and having at least two additional hydraulic rams secured to the frame and angularly offset from each other.

5. The coiled tubing deployment system of claim 1, further comprising one or more contact blocks interposing the coiled tubing and each piston, wherein each piston engages a corresponding contact block in stabilizing the coiled tubing.

6. The coiled tubing deployment system of claim 1, further comprising an injector that interposes the guide arch and the monitoring support guide.

7. The coiled tubing deployment system of claim 6, further comprising a support frame that couples the injector to the monitoring support guide.

8. The coiled tubing deployment system of claim 1, wherein the one or more sensors comprises a pressure transducer communicably coupled to the at least two hydraulic rams to measure real-time pressure fluctuations of a hydraulic fluid as the coiled tubing acts on the hydraulic rams.

9. The coiled tubing deployment system of claim 1, wherein the one or more sensors comprises a flowmeter communicably coupled to the at least two hydraulic rams to measure real-time flow rates of a hydraulic fluid as the coiled tubing acts on the hydraulic rams.

10. The coiled tubing deployment system of claim 1, wherein the one or more sensors comprises a movement sensor coupled to the at least two hydraulic rams to measure axial translation of the pistons as the coiled tubing acts on the hydraulic rams.

11. The coiled tubing deployment system of claim 1, further comprising a control system communicably coupled to the at least two hydraulic rams for regulating a hydraulic fluid pressure within each hydraulic ram.

12. The coiled tubing deployment system of claim 1, wherein construction parameters for the coiled tubing are stored in a memory of the data acquisition system, and wherein the construction parameters are used to determine the real-time bending fatigue of the coiled tubing.

13. The coiled tubing deployment system of claim 1, further comprising a pressure sensor fluidly coupled to the coiled tubing to obtain real-time pressure measurements within the coiled tubing, wherein the data acquisition system receives and processes the real-time pressure measurements in determining the real-time bending fatigue of the coiled tubing.

14. The coiled tubing deployment system of claim 1, further comprising a set of reference sensors coupled to the offshore rig at a fixed surface point to monitor and detect heave and movement of the offshore rig and generate corresponding reference signals, wherein the data acquisition system receives and processes the corresponding reference signals to remove motion effects of the offshore rig from the one or more sensor signals in determining the real-time bending fatigue of the coiled tubing.

15. The coiled tubing deployment system of claim 1, further comprising a peripheral device communicably coupled to the data acquisition system to receive the output signal and provide a graphical output corresponding to the real-time bending fatigue of the coiled tubing at the select locations along the coiled tubing.

16. A method, comprising:

deploying coiled tubing from a reel positioned on an offshore rig and receiving the coiled tubing with a guide arch positioned on the offshore rig;

receiving the coiled tubing from the guide arch with a monitoring support guide fixed to the offshore rig and conveying the coiled tubing into water below the offshore rig from the monitoring support guide, the monitoring support guide having a frame and at least two hydraulic rams secured to the frame and angularly offset from each other, wherein each hydraulic ram includes a piston cylinder and a piston movable in and out of the piston cylinder;

measuring a length of the coiled tubing deployed from the reel with a depth counter positioned at a first fixed point relative to the coiled tubing and thereby generating one or more length measurement signals;

measuring a weight of the coiled tubing with a weight sensor positioned at a second fixed point relative to the coiled tubing and thereby generating one or more weight measurement signals;

measuring real-time lateral movement of the coiled tubing with respect to the monitoring support guide as the coiled tubing is deployed into the water with one or more sensors coupled to the at least two hydraulic rams and thereby generating one or more sensor signals;

receiving and processing the one or more length measurement signals, the one or more weight measurement signals, and the one or more sensor signals with a data acquisition system communicably coupled to the depth counter, the weight sensor, and the one or more sensors; and generating an output signal with the data acquisition system indicative of real-time bending fatigue of the coiled tubing at select locations along the coiled tubing.

17. The method of claim 16, wherein the one or more sensors comprises a pressure transducer communicably coupled to the at least two hydraulic rams, and wherein measuring the real-time lateral movement of the coiled tubing comprises measuring real-time pressure fluctuations of a hydraulic fluid with the pressure transducer as the coiled tubing acts on the hydraulic rams.

18. The method of claim 16, wherein the one or more sensors comprises a flowmeter communicably coupled to the at least two hydraulic rams, and wherein measuring the real-time lateral movement of the coiled tubing comprises measuring real-time flow rates of a hydraulic fluid with the flowmeter as the coiled tubing acts on the hydraulic rams.

19. The method of claim 16, wherein the one or more sensors comprises a movement sensor communicably coupled to the at least two hydraulic rams, and wherein measuring the real-time lateral movement of the coiled tubing comprises measuring axial translation of the pistons with the movement sensor as the coiled tubing acts on the hydraulic rams.

20. The method of claim 16, further comprising regulating a hydraulic fluid pressure within each hydraulic ram with a control system communicably coupled to the at least two hydraulic rams.

21. The method of claim 16, wherein construction parameters for the coiled tubing are stored in a memory of the data acquisition system, the method further comprising accessing and using the construction parameters in determining the real-time bending fatigue of the coiled tubing.

22. The method of claim 16, further comprising:

obtaining real-time pressure measurements within the coiled tubing with a pressure sensor fluidly coupled to the coiled tubing; and receiving and processing the real-time pressure measurements with the data acquisition system in determining the real-time bending fatigue of the coiled tubing.

23. The method of claim 16, further comprising:

monitoring and detecting heave and movement of the offshore rig with a set of reference sensors coupled to the offshore rig at a fixed surface point;

generating reference signals with the set of reference sensors indicative of real-time heave and movement of the offshore rig; and receiving and processing the reference signals with the data acquisition system and thereby removing motion effects of the offshore rig from the one or more sensor signals in determining the real-time bending fatigue of the coiled tubing.

24. The method of claim 16, further comprising:

receiving the output signal with a peripheral device communicably coupled to the data acquisition system; and generating a graphical output corresponding to the real-time bending fatigue of the coiled tubing at the select locations along the coiled tubing.

25. The method of claim 24, wherein generating the graphical output comprises generating a map of the coiled tubing versus estimated fatigue on the coiled tubing at select locations along the coiled tubing.

26. The method of claim 16, further comprising mapping the coiled tubing with the data acquisition system to obtain a fatigue history file for the coiled tubing.

* * * * *